US008973498B2

(12) United States Patent
Kawashima

(10) Patent No.: US 8,973,498 B2
(45) Date of Patent: Mar. 10, 2015

(54) RECORDING APPARATUS

(75) Inventor: Hideki Kawashima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 854 days.

(21) Appl. No.: 13/170,962

(22) Filed: Jun. 28, 2011

(65) Prior Publication Data

US 2012/0000383 A1 Jan. 5, 2012

(30) Foreign Application Priority Data

Jul. 5, 2010 (JP) ..... 2010-152989

(51) Int. Cl.
*B41J 15/00* (2006.01)
*B41F 31/16* (2006.01)
*B41J 15/04* (2006.01)

(52) U.S. Cl.
CPC ..... *B41J 15/044* (2013.01)
USPC ..... 101/336; 400/611; 400/613

(58) Field of Classification Search
USPC ..... 400/194, 196, 207, 208.1, 613, 611; 101/336
See application file for complete search history.

(56) References Cited

U.S. PATENT DOCUMENTS

| | | | | |
|---|---|---|---|---|
| 6,361,229 | B1 | 3/2002 | Shinga | |
| 8,421,833 | B2 * | 4/2013 | Maruyama | 347/221 |
| 2007/0147936 | A1 * | 6/2007 | Ando et al. | 400/579 |
| 2008/0219739 | A1 * | 9/2008 | Hoffman | 400/207 |

FOREIGN PATENT DOCUMENTS

| | | | |
|---|---|---|---|
| CN | 1202091 | A | 12/1998 |
| CN | 1222886 | A | 7/1999 |
| CN | 101578181 | A | 11/2009 |
| EP | 1798050 | A1 | 6/2007 |
| EP | 2053002 | A2 | 4/2009 |
| EP | 1918117 | B1 | 1/2010 |
| JP | 07-081813 | A | 3/1995 |
| JP | 2000-335791 | A | 12/2000 |
| JP | 2002-003023 | A | 1/2002 |
| JP | 2006-306511 | A | 11/2006 |
| JP | 2008-087861 | A | 4/2008 |

* cited by examiner

*Primary Examiner* — Matthew G Marini
(74) *Attorney, Agent, or Firm* — Canon USA Inc IP Division

(57) ABSTRACT

There is provided a roll paper storage cassette and a recording apparatus which do not need a roll paper storage cassette according to the size of roll papers, and prevent a roll paper, a roll-paper shaft, and a roll paper storage cassette from being erroneously loaded. A roll paper storage cassette for housing a roll paper wound around the core portion of a roll paper shaft includes a pair of openable and closable cases, an attachment which can be attached and detached to and from the inside of both ends of the case according to the size of the roll paper, and a regulation member configured to prevent the roll paper shaft of a specific type from entering and allow the roll paper shaft of another specific type to enter in a state where the attachment is detached and configured to be moved from a position where the roll paper shaft of the specific type is prevented from entering in a state where the attachment is attached.

11 Claims, 15 Drawing Sheets

RECORDING APPARATUS

BACKGROUND OF THE INVENTION

1. Field of the Invention

The present invention relates to a recording apparatus and, in particular, to a roll paper storage cassette for storing roll paper.

2. Description of the Related Art

A sublimation type recording apparatus using roll paper as a recording medium has come into wide use for business purpose and for household purpose as well.

The roll paper can be continuously supplied, so that the use of the roll paper is advantageous in that a paper feeding operation can be completed in a shorter time period than a rectangle-paper feeding operation in a continuous recording. For this reason, the use of the roll paper allows completing all recording in a shorter time period than that of the rectangle-paper if a large amount of recording is continuously performed.

In addition to the above advantage, the use of the roll paper is advantageous in that no margin is left on a recorded object, in other words, borderless recording can be easily performed. When a new roll paper is used, instead of replacing a whole roll paper storage case in which the roll paper is stored, a user prepares a roll paper, inserts a roll-paper shaft into the roll paper, puts the roll paper in the roll paper storage cassette, and loads the roll paper storage cassette onto a printer body. This allows a recording cost to be reduced.

In a conventional technique, a roll paper storage cassette includes a cassette body for storing roll paper, a cassette lid having a rotating roller for promoting the rotation of the roll paper, and an arm one of which is connected to the cassette body and the other of which is connected to the cassette lid via a connection unit as discussed in Japanese Patent Application Laid-Open No. 2006-306511, for example.

The roll paper storage cassette is rotated with the connection unit as a center to cause the cassette lid to close the cassette body. The roll paper storage cassette into which the roll paper is stored is attached to and detached from the recording apparatus body.

The recording apparatus is desired to be able to use roll paper with a plurality of sizes from the standpoint of convenience. In a case where roll paper of a plurality of sizes can be used, it is desirable that the roll paper can be replaced before it runs short. However, once the roll paper is stored in the roll paper storage cassette, it is desirable not to open the roll paper storage cassette before the roll paper is used up.

More specifically, if a roll paper storage cassette corresponding to a type of roll paper is prepared, the roll paper can be stored without being dirtied, and the type of the roll paper can be detected without an error. The roll paper can be replaced only by replacing the cassette.

However, in a case where the recording apparatus can record on a plurality of roll papers of the different sizes, there are two problems.

A first problem is that a user has to inevitably prepare a plurality of roll paper storage cassettes corresponding to the types of roll paper if a dedicated roll paper storage cassette is prepared for each size of roll paper. Therefore, the recording cost is increased.

A second problem is that, in a case where the user inserts a roll-paper shaft into the roll paper and loads the roll paper onto the roll paper storage cassette intending to reduce a recording cost, the roll paper may be used with the combination being incompatible among the roll paper, roll-paper shaft, and the roll paper storage cassette. The use of the roll paper with the combination being incompatible among the roll paper, roll-paper shaft, and the roll paper storage cassette causes the disagreement of a recording range and a feed rate of the roll paper, producing protrusion and margin to degrade recording quality.

SUMMARY OF THE INVENTION

The present invention is directed to a roll paper storage cassette and a recording apparatus which do not need a roll paper storage cassette corresponding to each size of a plurality of roll papers and can prevent a roll paper, a roll-paper shaft, and a roll paper storage cassette from being erroneously loaded.

According to an aspect of the present invention, a roll paper storage cassette housing a roll paper wound around the core portion of a roll paper shaft includes a pair of openable and closable cases, an attachment which can be detached to the inside of both ends of the case according to the size of the roll paper, and a regulation member configured to prevent the roll paper shaft of a specific type from entering and allow the roll paper shaft of another specific type to enter in a state where the attachment is detached and configured to be moved from a position where the roll paper shaft of the specific type is prevented from entering in a state where the attachment is attached.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

In the accompanying drawings, the same reference is given to a component with the similar function. The description thereof is omitted herein.

Figure 1:
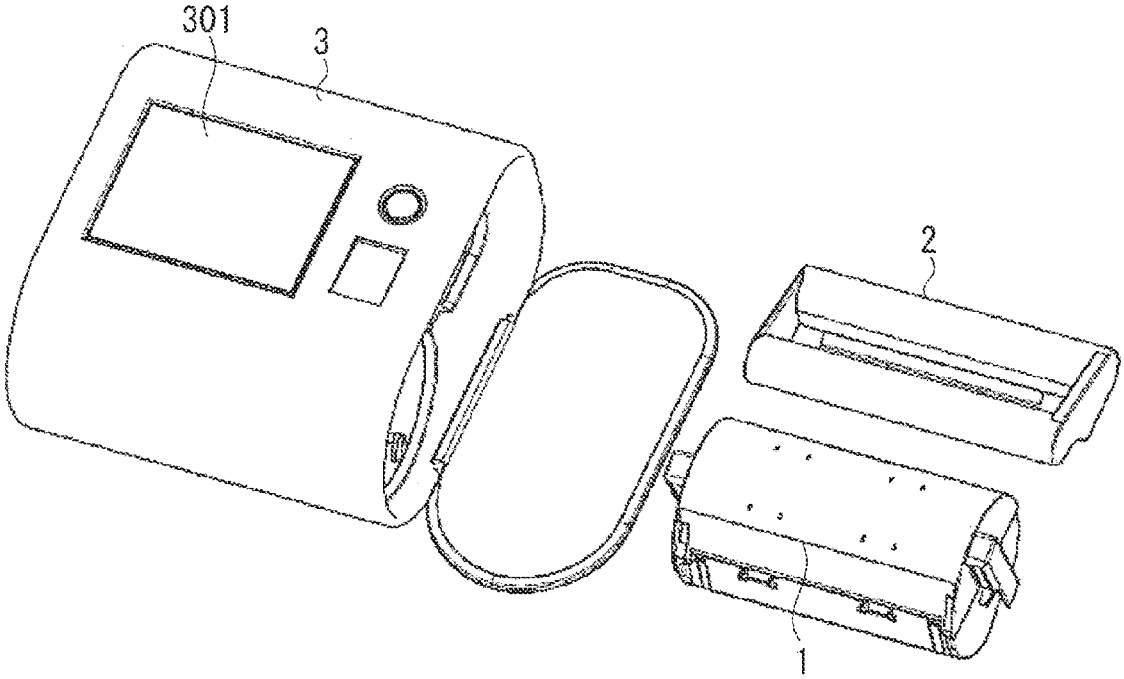
FIG. 1 illustrates an external schematic diagram of an example recording apparatus according to an exemplary embodiment of the present invention.

FIG. 1 is an external schematic diagram illustrating an example recording apparatus according to an exemplary embodiment of the present invention.

The recording apparatus according to the exemplary embodiment of the present invention includes a recording apparatus body 3, an ink ribbon cassette 2 housed in the recording apparatus body 3, and a roll paper storage cassette 1. The ink ribbon cassette 2 and the roll paper storage cassette 1 are detachable from the recording apparatus body 3.

In recording, the ink ribbon cassette 2 and the roll paper storage cassette 1 for housing and holding a roll paper R1 described below are loaded onto the recording apparatus body 3. Thereafter, an image desired to be recorded is selected using an operation unit 301 such as a touch panel of the recording apparatus body 3 to record the image on the roll paper R1 (refer to FIG. 2).

Figure 2:
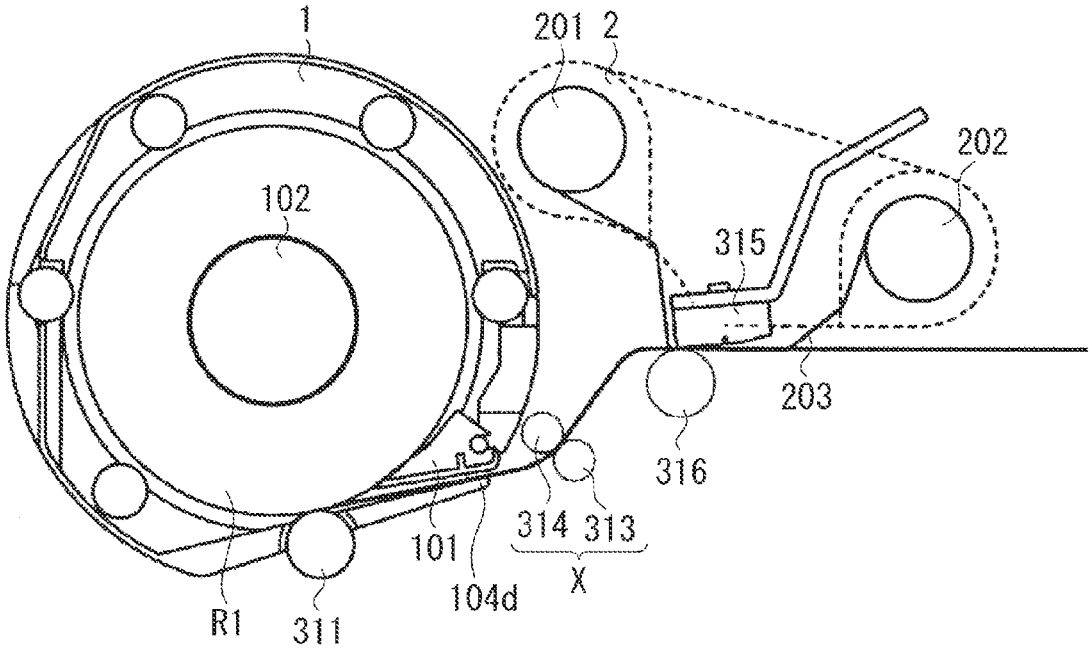
FIG. 2 is a schematic diagram of the principal part of the recording apparatus according to an exemplary embodiment of the present invention.

FIG. 2 is a schematic diagram of the principal part of the recording apparatus according to the present exemplary embodiment illustrating how the roll paper storage cassette 1 and the ink ribbon cassette 2 are arranged in the roll paper storage cassette 1.

The roll paper R1 (i.e., recording medium) is wound around a roll paper shaft 102 in a roll shape in the roll paper storage cassette 1. The roll paper storage cassette 1 is provided with a cassette outlet 104*d* so that the roll paper R1 can be discharged from the roll paper storage cassette 1. The recording apparatus body 3 is equipped with a feed roller 311 which is driven by a motor (not illustrated) and conveys the roll paper R1 in the roll paper storage cassette 1 to the cassette outlet 104*d*.

A roller pair X of a grip roller 313 on the surface of which a projection is provided and a pinch roller 314 being a driven roller positioned opposing to the grip roller 313 sandwiching the conveyance path of the roll paper R1 therebetween is provided in the downstream of the conveyance path of the roll paper R1 in the roll paper storage cassette 1.

The pinch roller 314 is strongly urged in the direction of the grip roller 313 to press the projection (not illustrated) on the surface of the grip roller 313 against the back face of the roll paper R1, thereby preventing the roll paper R1 from slipping on the roller surface. Therefore, the roll paper R1 is accurately conveyed over a desired distance.

A recording unit is provided at the downstream of the roller pair X. The recording unit is provided with a thermal head 315 and a platen roller 316 positioned opposing to the thermal head 315 sandwiching the conveyance path of the roll paper R1 therebetween. The thermal head 315 is almost integrally formed of a mounting frame (not illustrated) with a rotational center and an elastic member (not illustrated) and movable integrally with the mounting frame toward the platen roller 316 by the control of a cam gear (not illustrated).

The ink ribbon cassette 2 is provided with a supply bobbin 202 in which an ink ribbon 203 is contained and a take-up bobbin 201 for winding a used ink ribbon 203. When the ink ribbon cassette 2 is loaded onto the recording apparatus body 3, the supply bobbin 202 and the take-up bobbin 201 are supported by a shaft provided on the recording apparatus body 3. The take-up bobbin 201 is rotated by the same power source as that for driving the grip roller 313.

The supply bobbin 202 is freely rotatable. The ink ribbon 203 is wound around the supply bobbin 202 and the leading edge thereof is coupled to the take-up bobbin 201. The rotation of the take-up bobbin 201 winds the ink ribbon 203 from the supply bobbin 202.

The thermal head 315 includes a heating unit with a plurality of heating elements and selectively heats the heating elements according to recording information to thermally transfer ink uniformly applied to the ink ribbon 203 to the roll paper R1. More specifically, the thermal head 315 is pressed against the platen roller 316 to bring the ink ribbon 203 supplied from the supply bobbin 202 into close contact with the roll paper R1 under an appropriate pressure and at an appropriate temperature, enabling the ink to be thermally transferred to the roll paper R1.

Although not illustrated, there is provided a cutter for cutting a recorded portion of the roll paper R1 and a conveyance roller (not illustrated) for conveying a recorded object cut off from the roll paper R1 to a storage unit (not illustrated) in the downstream of the conveyance path of the roll paper R1 in the recording unit.

A recording operation is described below. The roll paper R1 is previously pulled out on the downstream side by a length required for recording at the time of feeding paper. When image data are prepared, recording is performed while the roll paper R1 is conveyed upstream by the grip roller 313 with the thermal head 315 pressed in the direction of the platen roller 316.

In recording, the ink ribbon 203 is brought into close contact with the roll paper R1 by the thermal head 315 and the platen roller 316 and heat is applied to the ink ribbon 203 by the heating element provided in the thermal head 315 to transfer the ink of the ink ribbon 203 to the roll paper R1. The ink ribbon 203 is also conveyed in the same direction as the roll paper R1 is conveyed (upstream) and a used ink ribbon is wound by the take-up bobbin 201.

The sublimation type recording apparatus of the present exemplary embodiment has to superimpose yellow, magenta, and cyan in a case where color printing such as a photo is performed. For this reason, as soon as recording in yellow is finished at first, the roll paper R1 is conveyed again to a position where recording is started and recording in magenta is performed similar to the recording in yellow. The similar operation is repeated by the number of colors to complete recording in all colors. Then, the roll paper R1 is conveyed and the recorded portion thereof is cut off by a cutter and discharged by the conveyance roller to the storage unit.

In a case where the next image is recorded in succession, the roll paper R1 is conveyed to the position where recording is started and the recording operation is again started. In a case where the next image is not to be recorded, the feed roller 311 is rotated reversely from the case where the paper is fed to draw the leading edge of the roll paper R1 into the roll paper storage cassette 1, bringing the roll paper R1 into a standby state.

Figure 3:
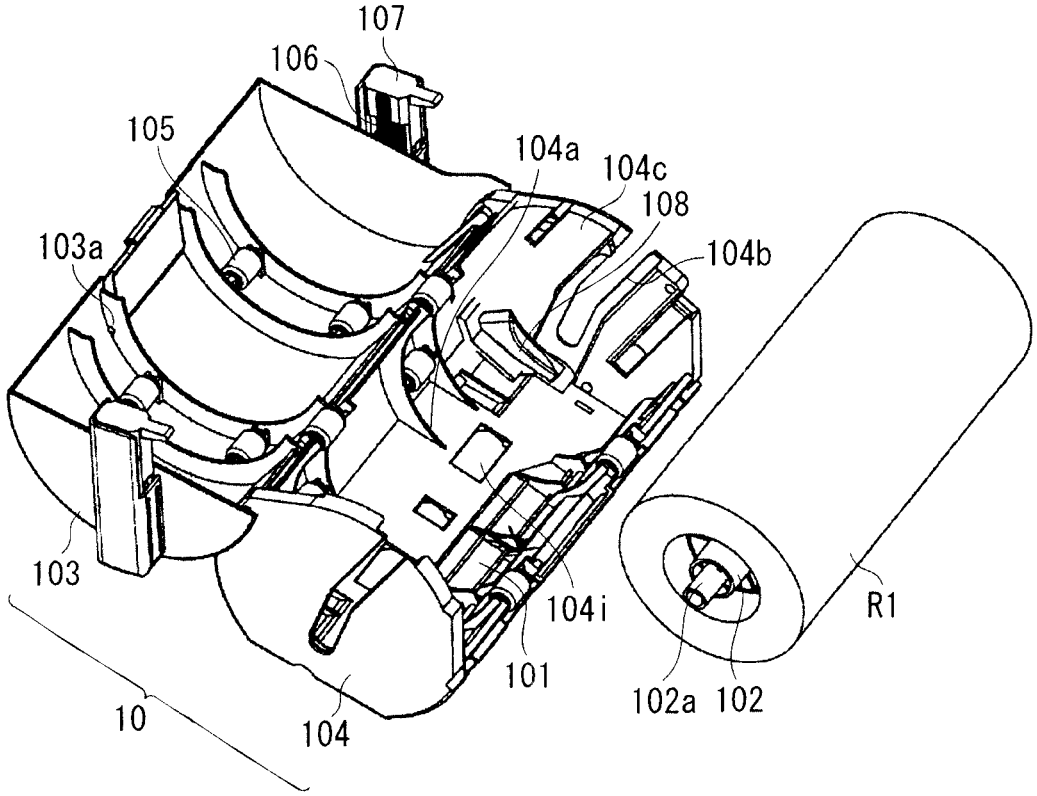
FIG. 3 is a schematic perspective view of the roll paper to which the roll paper shaft is attached and the opened roll paper storage cassette.

FIG. 3 is a schematic perspective view of the roll paper R1 to which the roll paper shaft 102 is attached and the opened roll paper storage cassette 1. The configuration of the roll paper storage cassette 1 is described further in detail below with reference to FIG. 3.

The roll paper storage cassette 1 is mainly formed of the roll paper R1, a roll paper storage case 10, and the roll paper shaft 102. As an example of a method for replacing the roll paper R1, the user prepares only the roll paper R1, the roll paper shaft 102 is inserted into the roll paper R1, and the roll paper R1 is stored in the roll paper R1. This method is advantageous in cost and natural resources saving because there are no objects to be disposed and recycled and no paper to be collected after the roll paper R1 is used up.

If user-friendliness is prioritized, various forms according to the object can be adopted in such a manner that the roll paper R1 is previously wound around the roll paper shaft 102 or the roll paper R1 is previously loaded onto the roll paper storage cassette 1, as another method.

The roll paper storage cassette 1 has a pair of openable and closable cases formed of upper and lower cases 103 and 104. The upper case 103 can be opened and closed with respect to the lower case 104. A plurality of ribs 103*a* and 104*a* and a plurality of driven rollers 105 for reducing a conveyance resistance are provided on the inner peripheral surfaces of the cases 103 and 104.

On the inner surfaces of both ends of the lower case 104 is provided a concave groove 104*e* (See FIGS. 12A and 12B) for guiding the projection of the roll paper shaft to be described below, which passes through the center of an end face and extends from a certain position on the periphery of the end face to the vicinity of position on the periphery of the end face having a point symmetry with respect to the certain position.

Inside the concave groove 104*e* is provided with a slot 104*b* for the supported portion of the roll paper shaft 102, which passes through the end face along the concave groove 104*e*. The concave groove 104*e* is greater in width than the slot 104*b* for the supported portion.

The upper case 103 is provided with a pressure spring 106 for urging the roll paper shaft 102 and a pressure guide 107 slidable to the urging direction. The pressure springs 106 and the pressure guides 107 are provided at both ends of the upper case 103 and uniformly urge the supported portions 102*b* of the roll paper shaft 102 (refer to FIG. 7). Furthermore, there are provided a feed roller opening 104*i* for bringing the feed roller 311 provided on the recording apparatus body 3 and the roll paper R1 into contact with each other.

An inner wall 104*c* of end faces of the lower case 104 regulates the movement of the roll paper R1 to the width direction to reduce meandering and widthwise displacement of the roll paper R1. On one of the end faces of the lower case 104 is provided with a biasing guide 108 for urging the vicinity of end portion of the roll paper R1. The biasing guide 108 is slidable to the width direction of the roll paper R1 (the longitudinal direction of the lower case 104).

A method for supporting the biasing guide 108 is described below using FIG. 4. The biasing guide 108 presses the vicinity of the end face of the roll paper R1 to prevent the widthwise displacement and meandering of the roll paper R1.

The lower case 104 is provided with a pickup guide 101 for picking up the leading edge of the roll paper R1. The pickup guide 101 is always urged in the direction of the roll paper R1 by a spring (not illustrated). The leading edge of the pickup guide 101 abuts on the surface of the wound roll paper R1 to allow surely picking up the leading edge of the roll paper R1 at the time of feeding paper.

Figure 4A:
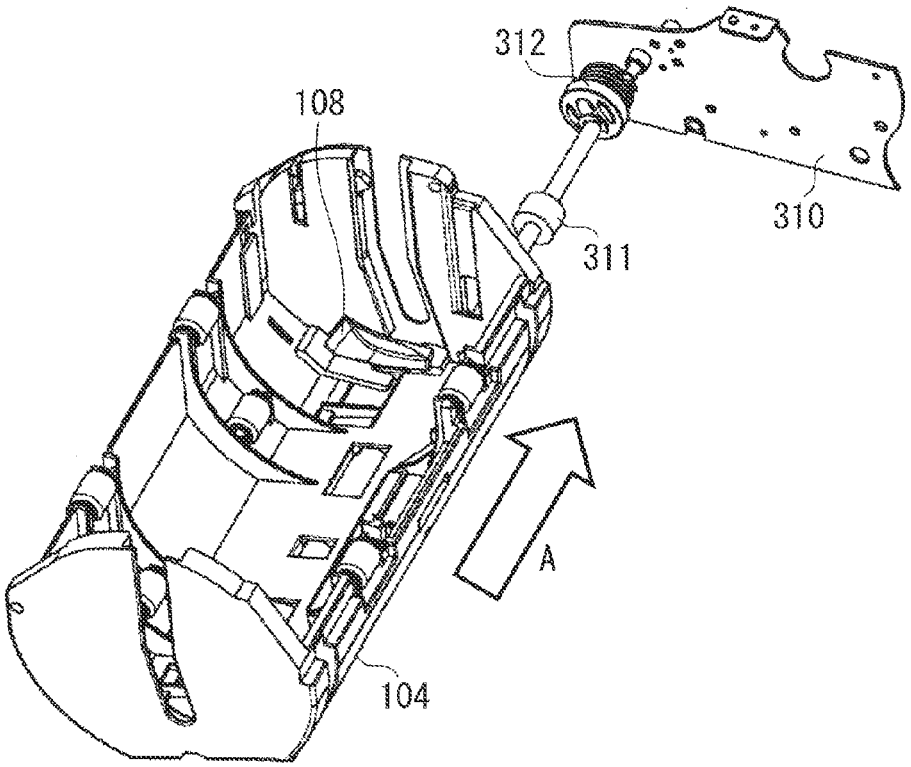
FIGS. 4A, 4B, and 4C illustrate a pressing method of a biasing guide.
Figure 4B:
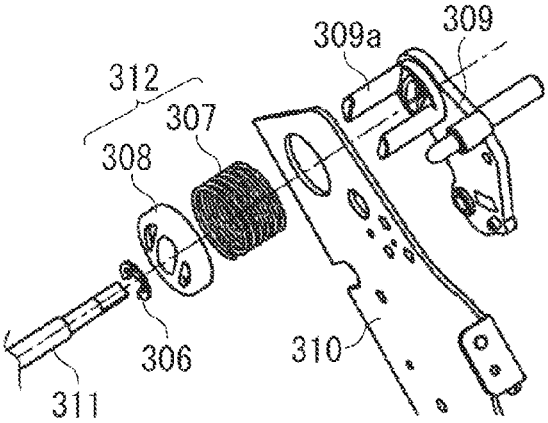
Figure 4C:
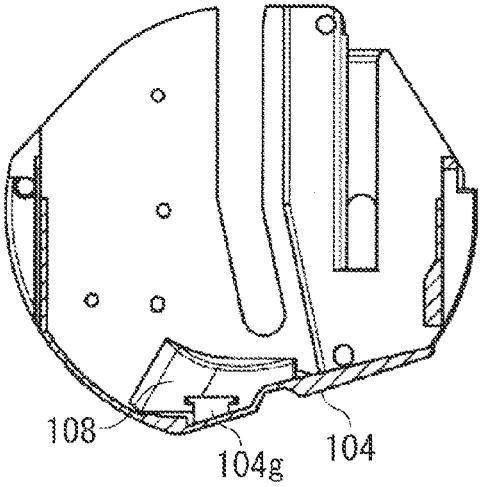

A pressing method of the biasing guide 108 urging the vicinity of the end portion of the roll paper R1 is described below with reference to FIGS. 4A to 4C. FIG. 4A is a schematic perspective view illustrating a state where the roll paper storage case 1 is being attached to the recording apparatus body 3. FIG. 4B is a developed view illustrating a configuration of an urging member and an attachment portion. FIG. 4C is a schematic cross section illustrating the biasing guide 108 viewed from the inside of the lower case 104.

For easy understanding of the structure, the upper case 103, the roll paper R1, and the roll paper shaft 102 are omitted. The lower case 104 is attached in the direction indicated by an arrow A.

The feed roller 311 is rotatably supported by a frame 310 inside the recording apparatus body 3 via a bearing 309 and provided with a slidable urging member 312 coaxial with the feed roller 311. The urging member 312 includes a slider 308 contacting the biasing guide 108 and a compression spring 307, and is slidably supported by a projection 309*a* projected from a bearing 309.

The leading edge of the slider 308 is regulated by an E ring 306. The urging member 312 can intrude into the end face of the lower case 104. The lower case 104 is inserted into the recording apparatus body 3 to cause the urging member 312 to press the biasing guide 108 attached to the lower case 104.

The biasing guide 108 is slidably supported by a T-shaped projection 104*g* provided on the lower case 104. For this reason, the lower case 104 is inserted into the recording apparatus body 3 and then the biasing guide 108 slides inward in the longitudinal direction of the lower case 104 to allow urging the end portion of the roll paper R1 and preventing the widthwise displacement and meandering of the roll paper R1.

The movement of the pressure guide 107 and the direction in which the supported portion is pressed are described below with reference to FIGS. 5A and 5B.

Figure 5A:
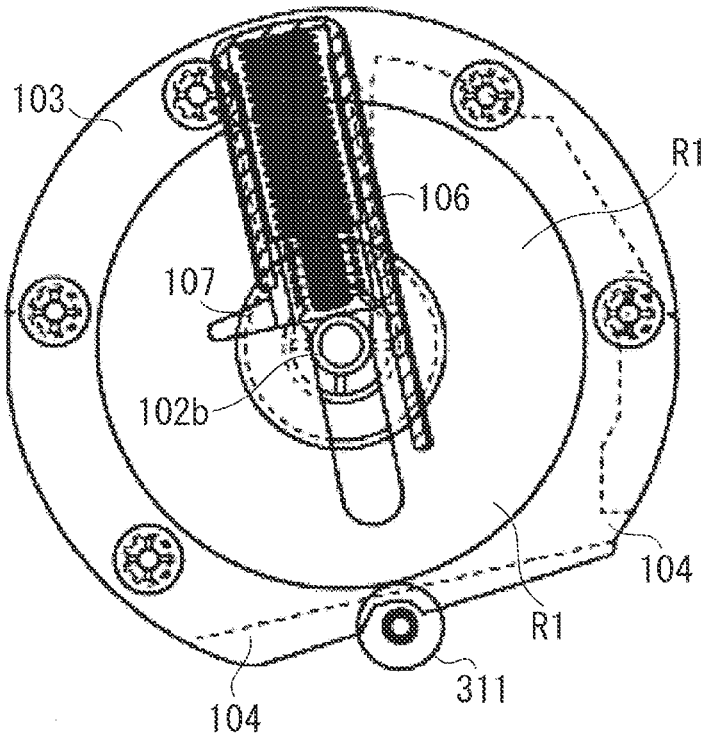
FIGS. 5A and 5B are schematic diagrams illustrating an end face of the roll paper storage cassette with an upper case closed.
Figure 5B:
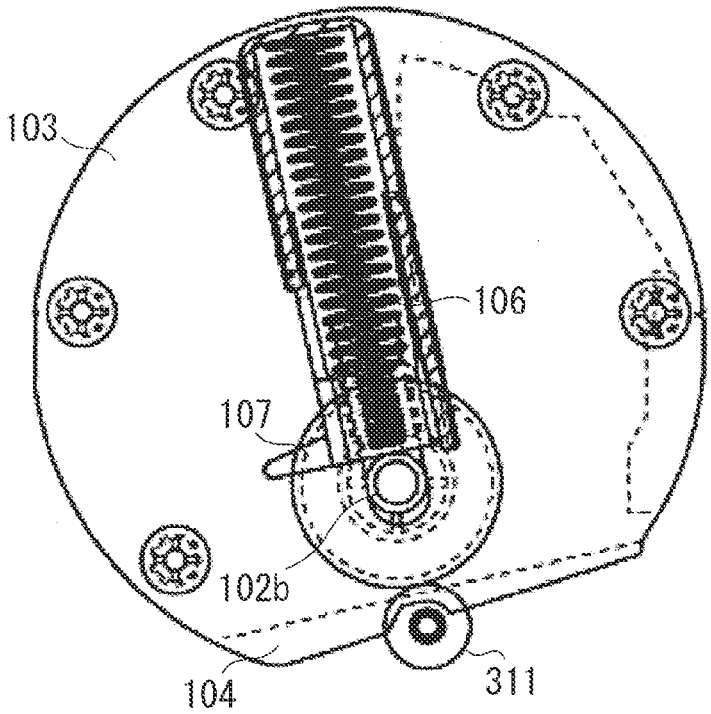

FIGS. 5A and 5B are schematic diagrams illustrating the end face of the roll paper storage cassette 1 with the upper case 104 closed. FIG. 5A illustrates a state where the roll paper R1 is not yet used. FIG. 5B illustrates a state where the roll paper R1 is used up. The feed roller 311 is also illustrated on the assumption that the roll paper storage case 1 is loaded on the recording apparatus body 3. FIGS. 5A and 5B also illustrate how the pressure spring 106 works.

When the roll paper R1 into which the roll paper shaft 102 is inserted is stored in the lower case 104 and the upper case 103 is closed, the elastic force of the compressed pressure spring 106 urges the pressure guide 107 to press the supported portion 102*b* to the direction of the feed roller 311. As a result, the surface of the wound roll paper R1 is pressed against the feed roller 311.

When the feed roller 311 is rotated so that the leading edge of the roll paper R1 is conveyed to the cassette outlet 104*d* with the surface of the roll paper R1 pressed against the feed roller 311, the roll paper R1 is rotated to send out the leading edge of the roll paper R1 to the outside of the roll paper storage cassette 1.

In a case where an unused roll paper R1 is loaded, the supported portion 102*b* is away from the feed roller 311 and the pressure spring 106 is most fully compressed. Recording is performed on the roll paper R1 and the roll paper R1 becomes small in diameter according as the remaining amount of the roll paper R1 is reduced. When the roll paper R1 is used up, the supported portion 102*b* is the nearest to the feed roller 311.

At this point, the pressure spring 106 is loose. The pressure force that the surface of the wound roll paper R1 is pressed against the feed roller 311 is desirably strong and constant. However, as described above, the pressure spring 106 extends with reduction in the winding diameter of the roll paper R1, so that it is desirable to ensure the pressure force, make the winding diameter as large as possible, and make the winding number as large as possible, thereby keeping a spring constant low.

Figure 6:
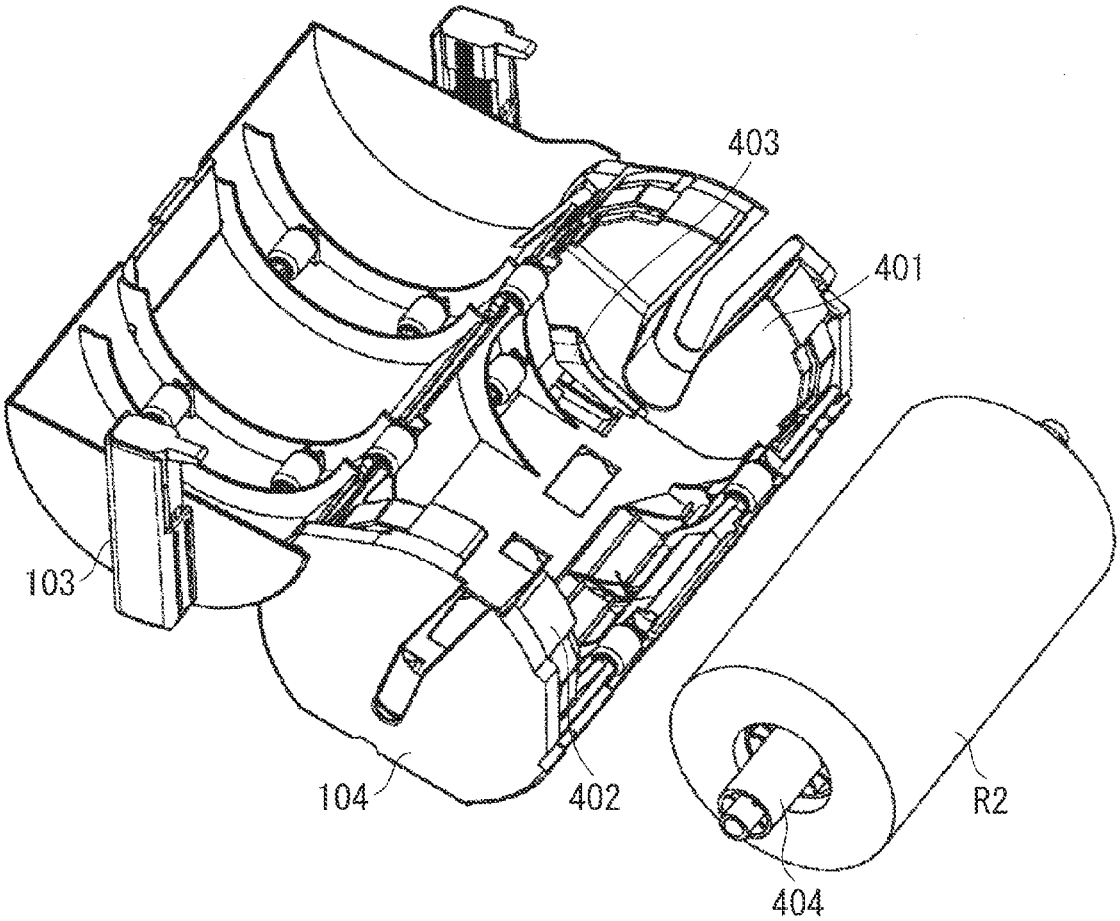
FIG. 6 is a schematic perspective view illustrating a postcard-sized roll paper into which the roll paper shaft is inserted, and the opened roll paper storage cassette to which attachments are attached.

The configuration of a roll paper and a roll paper storage cassette which is applicable to two types of roll papers are described below with reference to FIGS. 3 and 6. FIG. 3 illustrates an L-size roll paper R1 wide in width. FIG. 6 illustrates a postcard-sized roll paper R2 narrow in width. The cited roll papers R1 and R2 are examples. The present invention is applicable to two types of the roll papers with various sizes.

The roll paper storage cassette 1 corresponding to the L-size roll paper R1 illustrated in FIG. 3 and the roll paper storage cassette 1 corresponding to the postcard-sized roll paper R2 illustrated in FIG. 6 are common components.

The difference between FIGS. 3 and 6 is that the roll paper shafts 102 and 404 that are inserted into the roll papers R1 and R2 are different, and attachments 401 and 402 in FIG. 6 are attached to the roll paper storage cassette 1 if the postcard-sized roll paper R2 is used.

A dimensional relationship between the roll paper and the roll paper shaft is described below. The relationship in diameter and length between the roll papers R1 and R2 and the roll paper shafts 102 and 404 is described below with reference FIGS. 3 and 6 respectively.

Figure 7A:
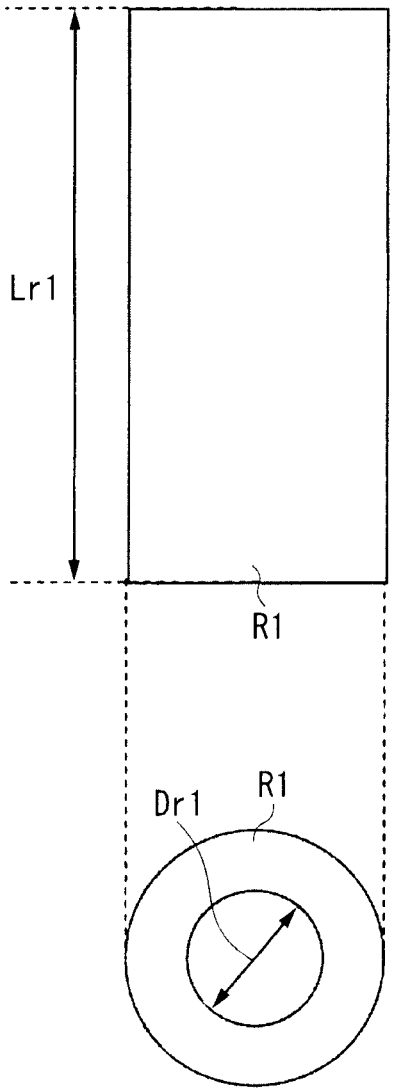
FIGS. 7A and 7B are schematic diagrams of the roll paper and the roll paper shaft illustrated in FIG. 2 respectively.
Figure 7B:
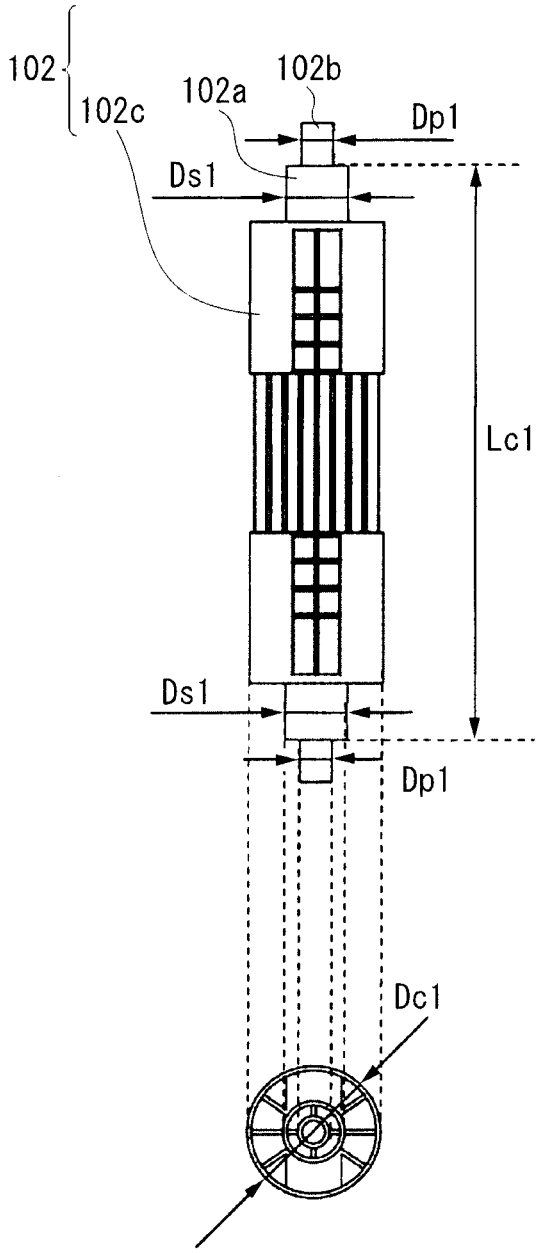

FIGS. 7A and 7B illustrate the L-size roll paper R1 and the roll paper shaft 102 illustrated in FIG. 2 respectively. FIG. 7A illustrates the dimension of the roll paper R1. FIG. 7B illustrates the dimension of the roll paper shaft 102.

The width of the roll paper R1 is Lr1. The inside diameter of the roll paper R1 is Dr1.

The roll paper shaft 102 includes a core portion 102*c* contacting the inner circumference portion of the roll paper R1, an end 102*a* projecting from the end face of the core portion 102*c*, and the supported portion 102*b* projecting from the end 102*a* and supported by the lower case 104. The core portion 102*c*, the end 102*a*, and the supported portion 102*b* increase in diameter in this order. The length between the ends 102*a* of the roll paper shaft 102 is Lc1. The diameter of the core portion 102*c* of the roll paper shaft 102 is Dc1. The diameter of the end 102*a* of the roll paper shaft 102 is Ds1. The diameter of the supported portion 102*b* is Dp1.

Since the roll paper shaft 102 needs to be capable of being inserted into the roll paper R1, a relationship of Dr1>Dc1 needs to be satisfied.

Figure 8A:
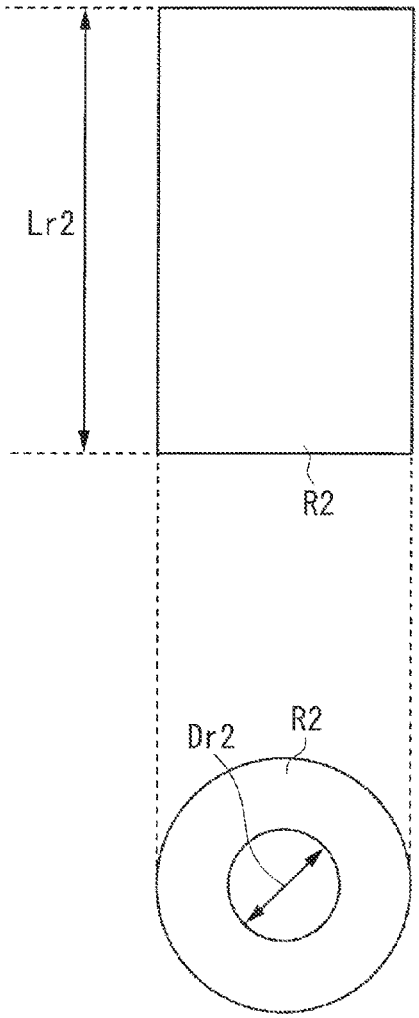
FIGS. 8A and 8B are schematic diagrams of the postcard-sized roll paper and the roll paper shaft illustrated in FIG. 6 respectively.
Figure 8B:
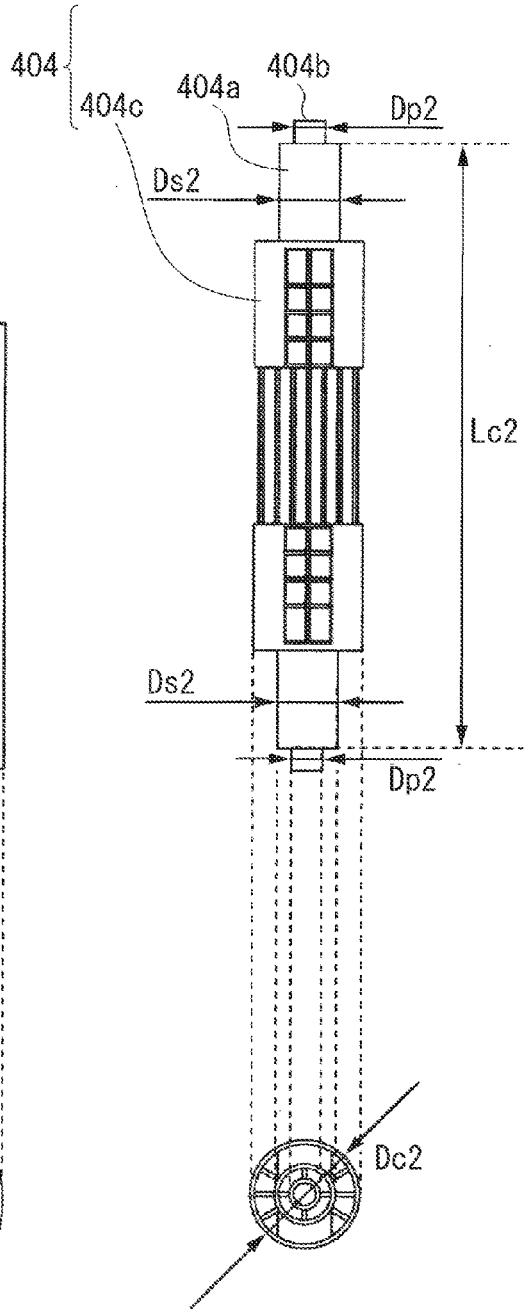

FIGS. 8A and 8B illustrate the postcard-sized roll paper R2 and the roll paper shaft 404 illustrated in FIG. 6 respectively. FIG. 8A illustrates the dimension of the roll paper R2. FIG. 8B illustrates the dimension of the roll paper shaft 404.

The width of the roll paper R2 is Lr2. The inside diameter of the roll paper R2 is Dr2. The width Lr2 of the roll paper R2 satisfies the following relationship.

$$Lr2<Lr1.$$

The roll paper shaft 404 includes a core portion 404*c* contacting the inner circumference portion of the roll paper R2, an end 404*a* projecting from the end face of the core portion 404*c*, and the supported portion 404*b* projecting from the end 404*a* and supported by the lower case 104. The core portion 404*c*, the end 404*a*, and the portion 404*b* increase in diameter in this order.

The length between the ends 404*a* of the roll paper shaft 404 is Lc2. The diameter of the core portion 404*c* of the roll paper shaft 404 is Dc2. The diameter of the end 404*a* of the roll paper shaft 404 is Ds2. The diameter of the supported portion 404*b* is Dp2.

Since the roll paper shaft 404 need to be capable of being inserted into the roll paper R2, a relationship of Dr2>Dc2 needs to be satisfied.

The present exemplary embodiment is characterized in that the relationship between the inside diameters of the L-size roll paper R1 and the postcard-sized roll paper R2 is given by Dr1>Dr2. The relationship between the diameter of the L-size roll paper shaft 102 and the inside diameters of the postcard-sized roll paper R2 is given by Dc1>Dr2, so that the L-size roll paper shaft 102 cannot be inserted into the postcard-sized roll paper R2.

The relationship in length between the ends 102*a* of the L-size roll paper shaft 102 and the ends 404*a* of the postcard-sized roll paper shaft 404 is given by Lc1<Lc2.

The roll paper storage cassette 1 using the attachments 401 and 402 is described below with reference to FIGS. 9A and 9B.

Figure 9A:
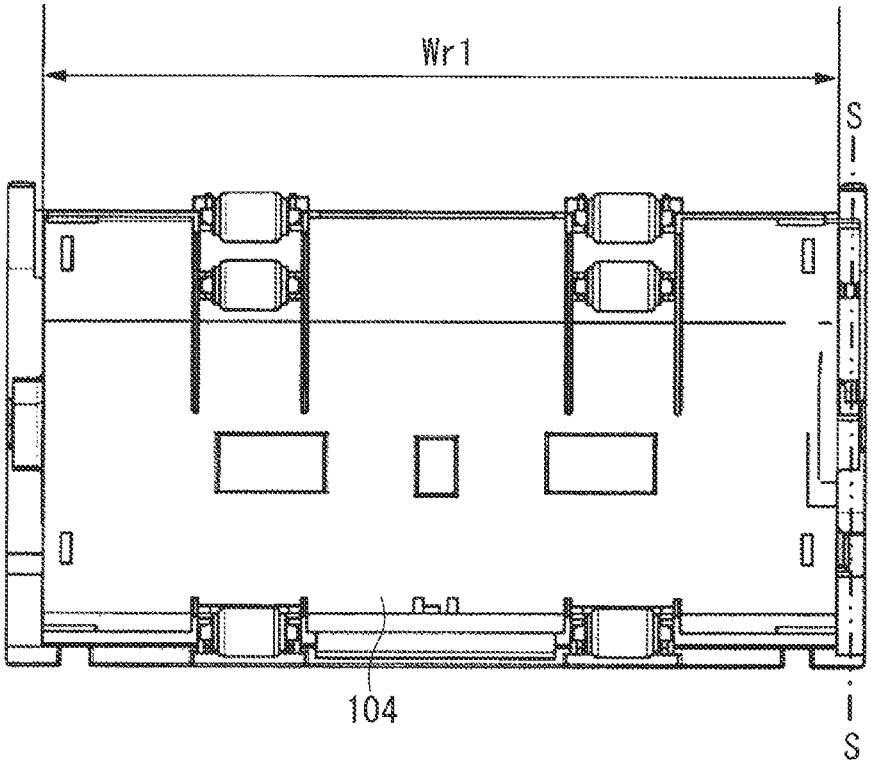
FIGS. 9A and 9B are top views of a lower case of the roll paper storage cassette.
Figure 9B:
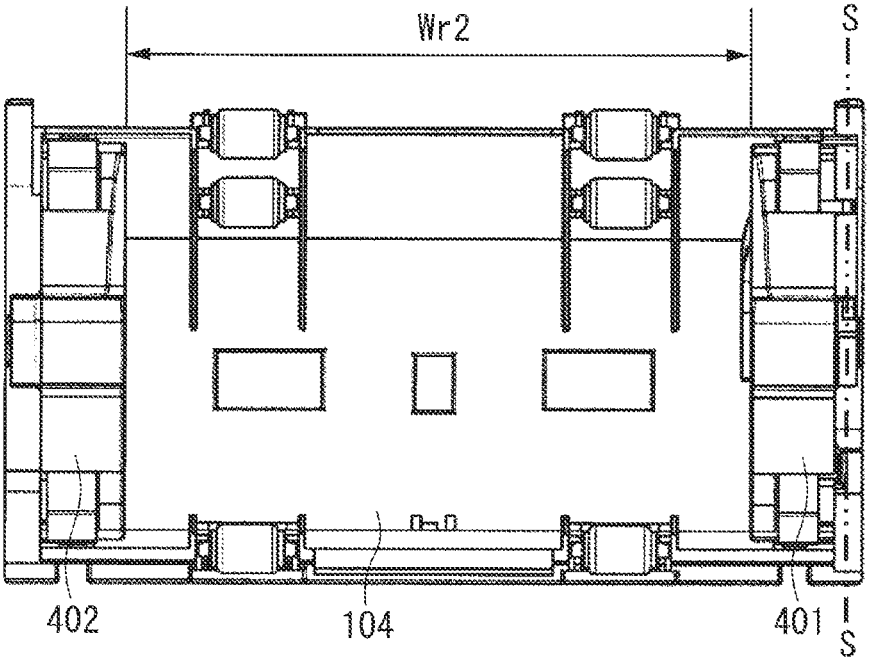

FIGS. 9A and 9B are top views of the lower case 104 of the roll paper storage cassette 1. FIG. 9A illustrates the lower case 104 to which the attachments 401 and 402 are not attached. FIG. 9B illustrates the lower case 104 to which the attachments 401 and 402 are attached.

If a roll paper storage width in a case where the attachments 401 and 402 are not attached to the lower case 104 (refer to FIG. 9A) is Wr1 and a roll paper storage width in a case where the attachments 401 and 402 are attached to the lower case 104 (refer to FIG. 9B) is Wr2, the relationship therebetween can be represented by Wr1>Wr2. Because Wr1>Lr1 and Wr2>Lr2, the L-size roll paper R1 can be loaded on the lower case 104 in a case where the attachments 401 and 402 are not attached (refer to FIG. 9A). The postcard-sized roll paper R2 can be loaded on the lower case 104 in a case where the attachments 401 and 402 are attached (refer to FIG. 9B).

The roll paper storage width of the lower case 104 in a case where the attachments 401 and 402 are attached is decreased by the widths of the attachments 401 and 402. If an attempt is made to put the L-size roll paper R1 into the roll paper storage cassette 1, the relationship between the roll paper storage width Wr2 and the width Lr1 of the L-size roll paper R1 is set as Wr2<Lr1, so that the L-size roll paper R1 cannot be put into the roll paper storage cassette 1.

Figure 10A:
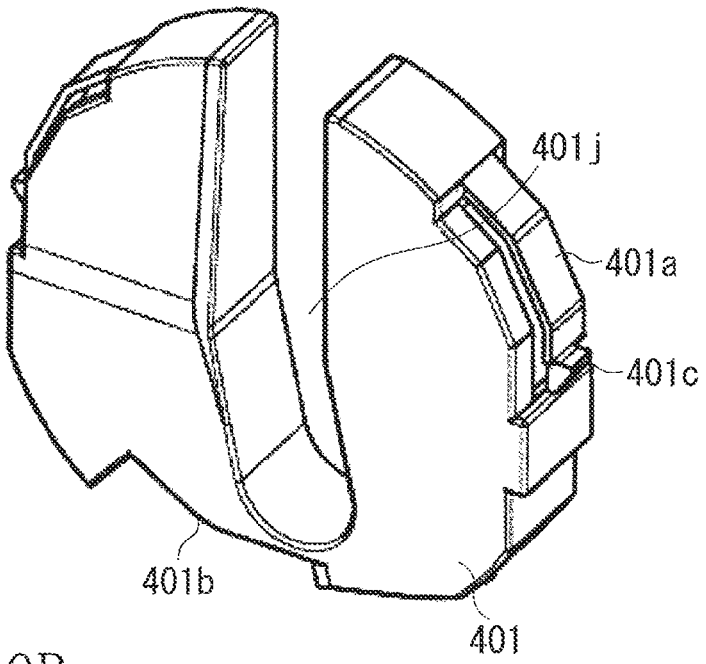
FIGS. 10A, 10B, and 10C are schematic perspective views of the attachment.
Figure 10B:
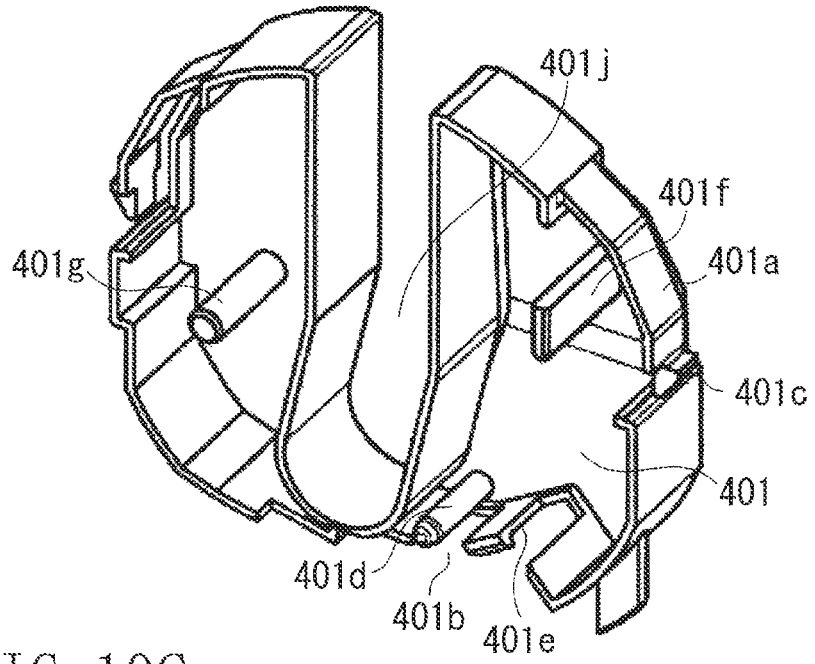
Figure 10C:
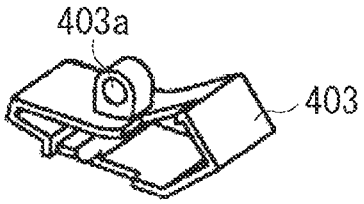

FIGS. 10A to 10C are schematic perspective views illustrating the attachment 401. FIG. 10A illustrates the face contacting the roll paper R2. FIG. 10B illustrates the other face (the face contacting the end face of the roll paper storage cassette 1). FIG. 10C illustrates a biasing guide 403 attached to the attachment 401. The attachment is described below with reference to FIGS. 10A to 10C.

The attachment 401 is provided with an elastically deformable arm 401*a*. When the attachment 401 is attached to the lower case 104, the arm 401*a* is bent and a claw 401*c* of the arm 401*a* is latched to a latch portion (not illustrated) of the lower case 104. When the attachment 401 is detached from the lower case 104, the arm 401*a* is bent again to retreat the arm 401*a* from the latch portion of the lower case 104, detaching the attachment 401 from the lower case 104.

A notch portion 401*b* is provided on one attachment 401 out of the two attachments 401 and 402 attached to the lower case 104. The biasing guide 403 is attached to the notch portion 401*b*. Another attachment 402 is not provided with the notch portion. A reference face on which the biased roll paper R2 abuts is formed.

The biasing guide 403 is attached from the other face of the attachment 401 illustrated in FIG. 10B. A hole 403*a* of the biasing guide 403 is fitted to a guide shaft 401*d* of the attachment 401 and the attachment 401 is slidably supported. The biasing guide 403 is attached to cause a hook portion 401*a* of the attachment 401 to regulate the movement of the biasing guide 403, preventing the biasing guide 403 from being detached.

The attachment 401 to which the biasing guide 403 is attached is fixed to the lower case 104 and then the postcard-sized roll paper R2 into which the roll paper shaft 404 is inserted is housed in the lower case 104. The upper case 103 is closed and the roll paper storage case 1 is loaded on the recording apparatus body 3. The urging member 312 described above using FIGS. 4A to 4C urges the biasing guide 108, pressing biasing guide 403 for the postcard-sized roll paper R2, which biases the roll paper R2.

Both in the attachments 401 and 402 are provided with slots 401*j* into which the ends 404*a* of the roll paper shaft 404 can be inserted.

A detection projection 401*g* for identifying the size of the roll paper is provided on the attachment. The type of the attachment 401 attached to the lower case 104 is different depending on the size of the roll paper. For that reason, the type of the attachment 401 is determined to allow the size of the roll paper to be detected. A method of detection is described below.

Furthermore, there is provided a projection 401*f* that forms a part of a mechanism for preventing the roll paper from being erroneously loaded. The above mechanism is described below.

Figure 11A:
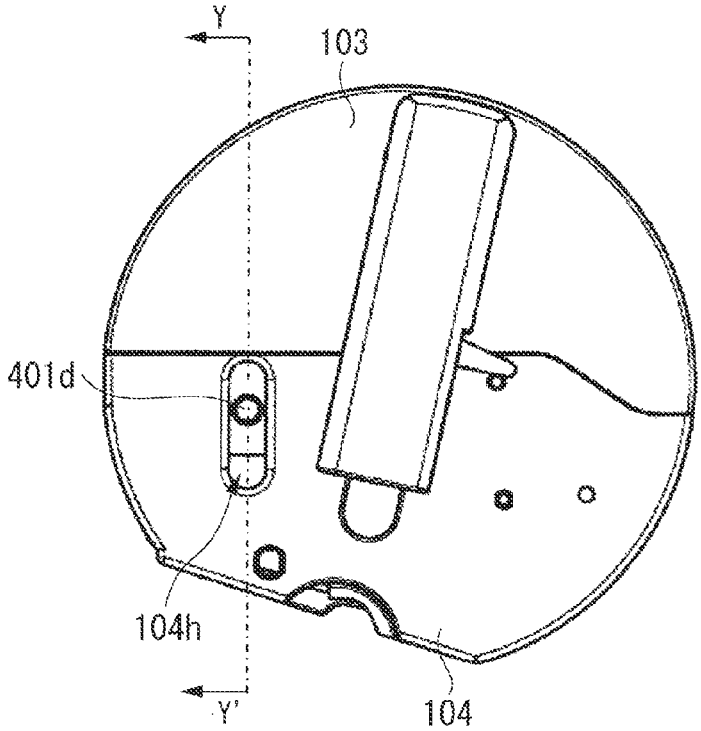
FIGS. 11A and 11B are schematic diagrams illustrating the roll paper storage case to which the attachment is attached.
Figure 11B:
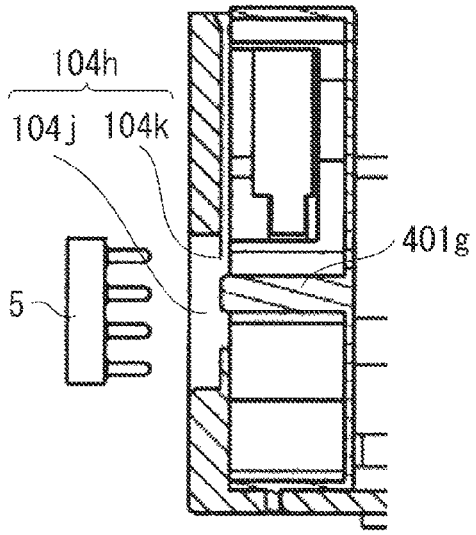

FIGS. 11A and 11B are schematic diagrams illustrating the roll paper storage case 1 to which the attachment 401 is attached. FIG. 11A is a schematic diagram in which the end of the roll paper storage case 1 on the side where the attachment 401 is attached is viewed from the outside. FIG. 11B is a schematic cross section taken along line Y-Y' of FIG. 11A.

On the end face of the lower case 104 includes a determination portion 104*h* with a concave portion 104*k* having a hole 104*j* passing through the center thereof. The leading edge of the projection portion 401*g* of the attachment 401 is positioned in the hole 104*j*. The projection portion 401*g* can be seen through the hole 104*j* even with the upper and lower cases 103 and 104 being closed.

An attachment identification sensor 5 with four projections is provided on the recording apparatus body 3. The projection is pressed to generate a signal, thereby determining the type of the attachment. Although not illustrated, in a case where the roll paper storage cassette 1 is loaded onto the recording apparatus body 3 without the attachment, the face of the concave portion 104*k* of the determination portion 104*h* presses only the lowermost projection of the sensor 5 to cause the sensor 5 to detect that no attachment is provided, i.e., the roll paper is of size L.

On the other hand, in a case where the roll paper storage cassette 1 with the attachment 401 being attached is loaded onto the recording apparatus body 3, the face of the concave portion 104*k* of the determination portion 104*h* and the projection portion 401*g* of the attachment 401 press the second projection of the sensor 5 from the top and the lowermost projection thereof. This causes the sensor 5 to detect that the roll paper is of postcard size.

The position of the projection portion 401*g* is changed or the number of the projection portion 401*g* is increased for each attachment to change the positions of the projections of the sensor 5 (i.e., attachment identification sensor), allowing the recognition of a plurality of types of the attachments.

The mechanism for preventing the roll paper from being erroneously loaded is described below with reference to FIGS. 12A and 12B.

In a case where the attachments 401 and 402 are not attached to the lower case 104 (refer to FIG. 9A), Wr1>Lr2. For this reason, the lower case 104 can store not only the L-size roll paper R1, but also the postcard-sized roll paper R2 and a card-sized roll paper R3 smaller in width than the L-size roll paper R1.

Then, the roll paper storage cassette 1 in the present exemplary embodiment is made unable to store the postcard-sized and card-sized roll papers R2 and R3 and able to store only the L-size roll paper R1 in a case where the attachments 401 and 402 are not attached to the lower case 104. For that reason, the following mechanism is provided for preventing the roll paper from being erroneously loaded.

Figure 12A:
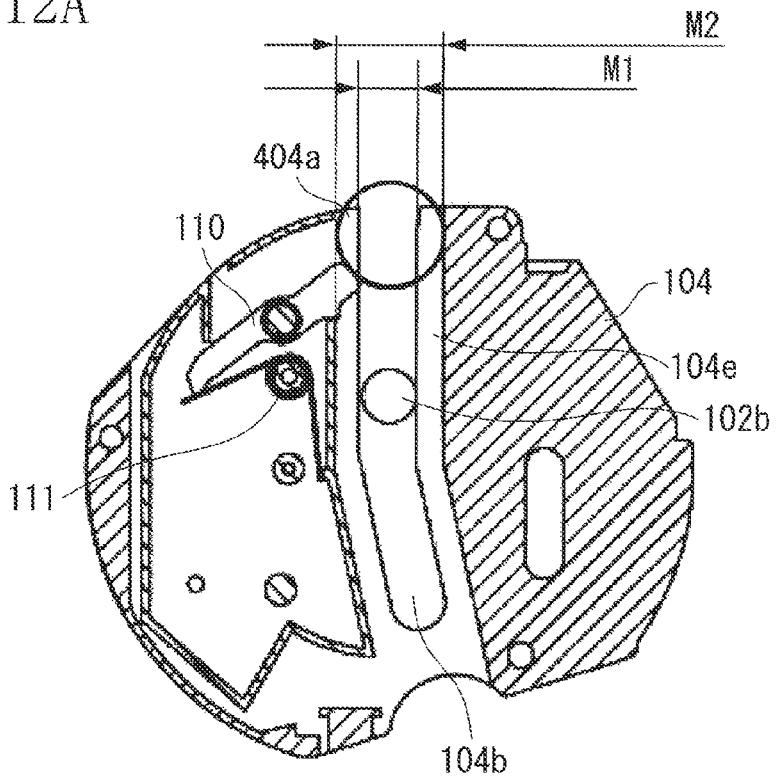
FIGS. 12A and 12B are schematic cross sections taken along line S-S of the lower case in FIGS. 9A and 9B.
Figure 12B:
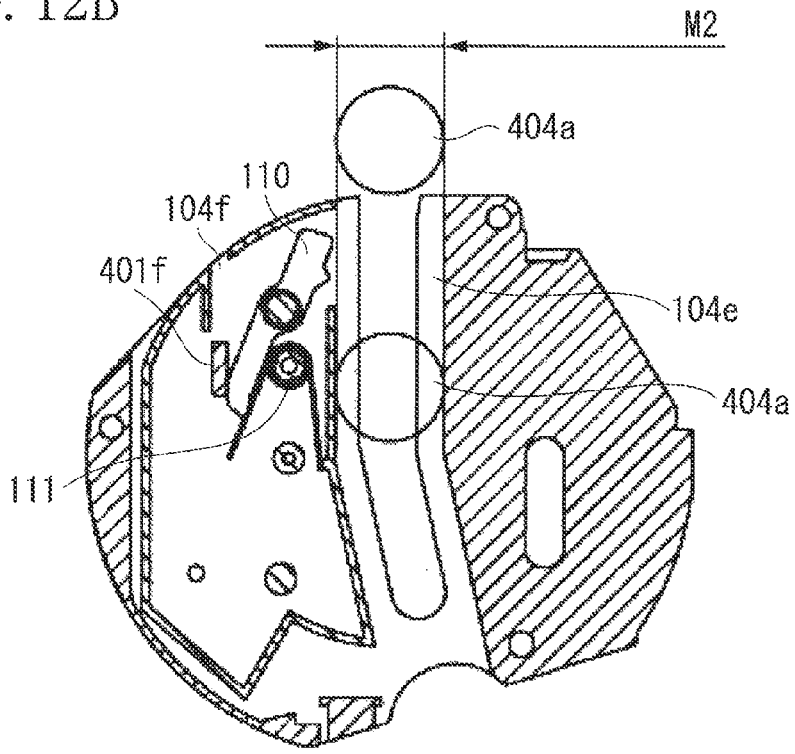

FIGS. 12A and 12B are schematic cross sections taken along line S-S of the lower case 104 illustrated in FIG. 9. FIG. 9A is the cross section in a case where the attachment 401 is not attached. FIG. 9B is the cross section in a case where the attachment 401 is attached.

The mechanism for preventing the roll paper from being erroneously loaded is formed of a torsion spring 111 provided on the end of the lower case 104, a regulating lever 110 as a regulating member, a slot 104*b* for the supported portion, the concave groove 104*e*, and the projection 401*f* of the attachment 401. As described above, the concave groove 104*e* is greater in width than the slot 104*b* for the supported portion.

If the width of the slot 104*b* for the supported portion is taken as M1 and the width of the concave groove 104*e* is taken as M2, M2>Ds2=Ds1>M1, and M1>Dp1=Dp2, where Lc2>Wr1>Lc1.

In a state where the attachment is not attached, the regulating lever 110 is rotated by the torsion spring 111 urging and can be positioned in the concave groove 104*e* (this position is taken as a regulation position). However, the regulating lever 110 is never positioned in the slot 104*b* for the supported portion.

As illustrated in FIG. 12A, in a state where the attachment 401 is not attached, the regulating lever 110 is urged in a clockwise direction by the torsion spring 111 to project to the concave groove 104*e*, in other words, the regulating lever 110 is positioned at the regulation position. For the roll paper shaft 102 used for the L-size roll paper R1, as Wr1>Lc1, only the supported portions 102*b* having a diameter of Dp1 passes along the concave groove 104*e* and the slot 104*b* for the supported portion. Therefore, although the regulating lever 110 projects to the concave groove 104*e*, the roll paper shaft 102 is arranged in a predetermined position.

On the other hand, for the roll paper shaft 404 used for the postcard-sized roll paper R2, as Lc2>Wr1, the end 404*a* with a diameter of Ds2 of the roll paper shaft 404 needs to pass along the concave groove 104*e*. For that reason, if an attempt is made to press the roll paper shaft 404 into the predetermined position, the regulating lever 110 prevents the end 404*a* of the roll paper shaft 404 from entering, thereby the roll paper shaft 404 cannot be pressed thereinto.

As illustrated in FIG. 12B, if the attachment 410 (FIG. 12 illustrates only the projection 401*f*) is attached to the lower case 104, the projection 401*f* provided on the attachment 401 passes along an opening 104*f* and is pressed thereinto. The projection 401*f* abuts on the regulating lever 110 to press the regulating lever 110. The pressed regulating lever 110 is rotated counterclockwise and retreated from the concave groove 104*e* (the position is taken as a non-regulation position). Consequently, the end 404*a* of the roll paper shaft 404 for the postcard-sized roll paper R2 is movable along the concave groove 104*e* and the roll paper shaft 404 for the postcard-sized roll paper R2 can be arranged in the predetermined position.

As described above, in a state where the attachments 401 and 402 are not attached, the regulating lever 110 prevents the roll paper shaft of a specific type (or, the roll paper shaft 404 for the postcard-sized roll paper R2). At the same time, the regulating lever 110 allows the roll paper shaft of another specific type (the roll paper shaft 102 for the L-size roll paper R1) to enter. The attachments 401 and 402 are attached to move the regulating lever 110 from the position where the roll paper shaft 404 for the postcard-sized roll paper R2 is prevented from entering to the position where the roll paper shaft 404 is not prevented.

Since Wr2<Lr1, the L-size roll paper R1 cannot be loaded onto the roll paper storage cassette 1 to which the attachments 401 and 402 are attached. Furthermore, since Wr1<Lc2, the roll paper shaft 404 for the postcard-sized roll paper R2 cannot enter the roll paper storage cassette 1 to which the attachments 401 and 402 are not attached.

Furthermore, recording can be performed in a state where the size of the roll paper detected by a cassette-type detection switch 5 in loading the roll paper storage cassette 1 onto the printer body 3 agrees with the size of the roll paper actually loaded onto the roll paper storage cassette 1. For this reason, the control of the amount of conveyance of the roll paper and the setting of a recording size can be correctly performed to enable preventing the occurrence of paper jam, the protrusion of a recording image, and margin.

Since Dc1>Dr2, the roll paper shaft 102 for the L-size roll paper R1 cannot be inserted into the postcard-sized roll paper R2.

If the roll paper storage cassette according to the size of each roll paper can be prepared, instead of using the roll paper having a plurality of sizes with a common roll paper storage cassette 1, the attachments 401 and 402 may be integrated with the lower case 104.

In this case, the roll paper can be prevented from being erroneously loaded only by providing the slot 104*b* for the supported portion having a width of M1 and the concave groove 104*e* having a width of M2 can prevent, so that there is no need for preparing the mechanism for preventing the roll paper from being erroneously loaded using the regulating lever 110, which can simply prevent the roll paper from being erroneously loaded.

A roll paper storage cassette in another exemplary embodiment of a recording apparatus according to the present invention is described below with reference to FIG. 13. In the above-described exemplary embodiment, the roll paper has two different types. In the present exemplary embodiment, the roll paper has three different types; the foregoing two types of roll papers R1 and R2 and a newly added card-sized roll paper R3. The description of the configuration similar to that in the above-described exemplary embodiment is omitted herein.

Figure 13:
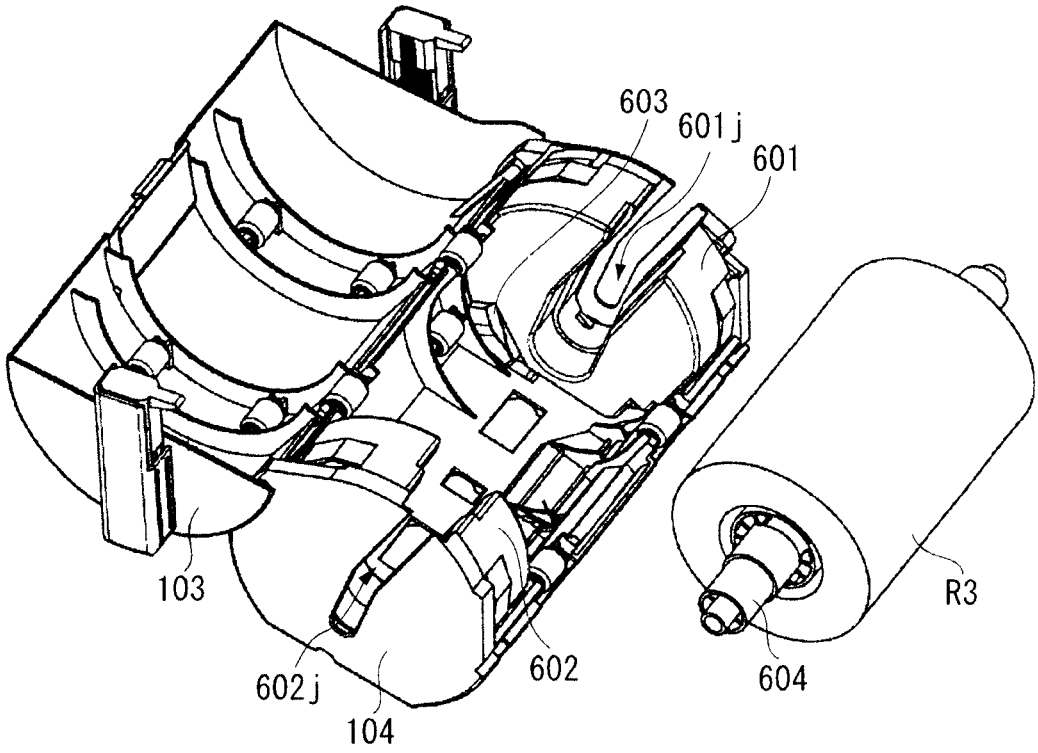
FIG. 13 is a schematic diagram illustrating the roll paper storage cassette and the card-sized roll paper.

FIG. 13 is schematic diagram illustrating a roll paper storage cassette 1 and the card-sized roll paper R3.

When the card-sized roll paper R3 is used, as is the case with the use of the postcard-sized roll paper R2, attachments 601 and 602 for the card-sized roll paper R3 are attached to the roll paper storage cassette 1.

Although the attachments 601 and 602 are basically similar in configuration to the attachments 401 and 402 for the postcard-sized roll paper R2, slots 601*j* and 602*j* for fixing a roll paper shaft 604 (refer to FIG. 14) are different in shape. Each of the slots 601*j* and 602*j* in the present exemplary embodiment has two-stage width because a step is provided. The width is smaller on the side of end of the lower case 104 and larger on the side where the attachment contacts the roll paper R3.

As is the case with the attachment 401 for the postcard-sized roll paper R2, a biasing guide 603 for biasing the outer periphery of the card-sized roll paper R3 is fixed to the attachment 601.

Figure 14A:
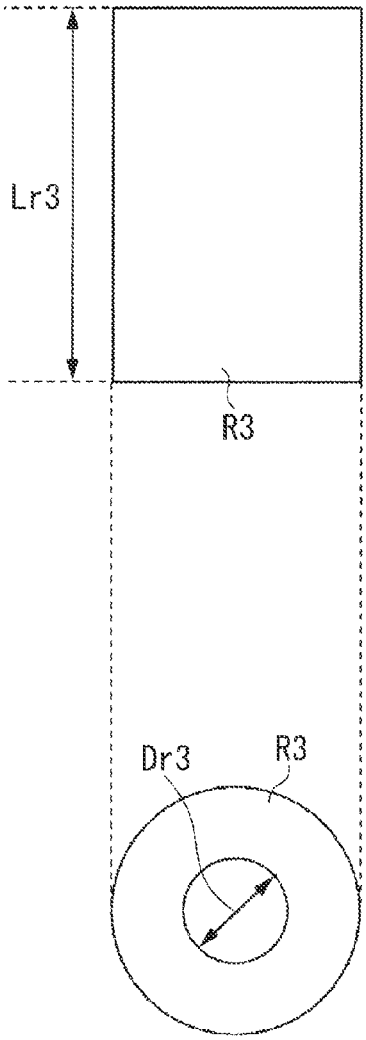
FIGS. 14A and 14B illustrate the card-sized roll paper and the roll paper shaft respectively.
Figure 14B:
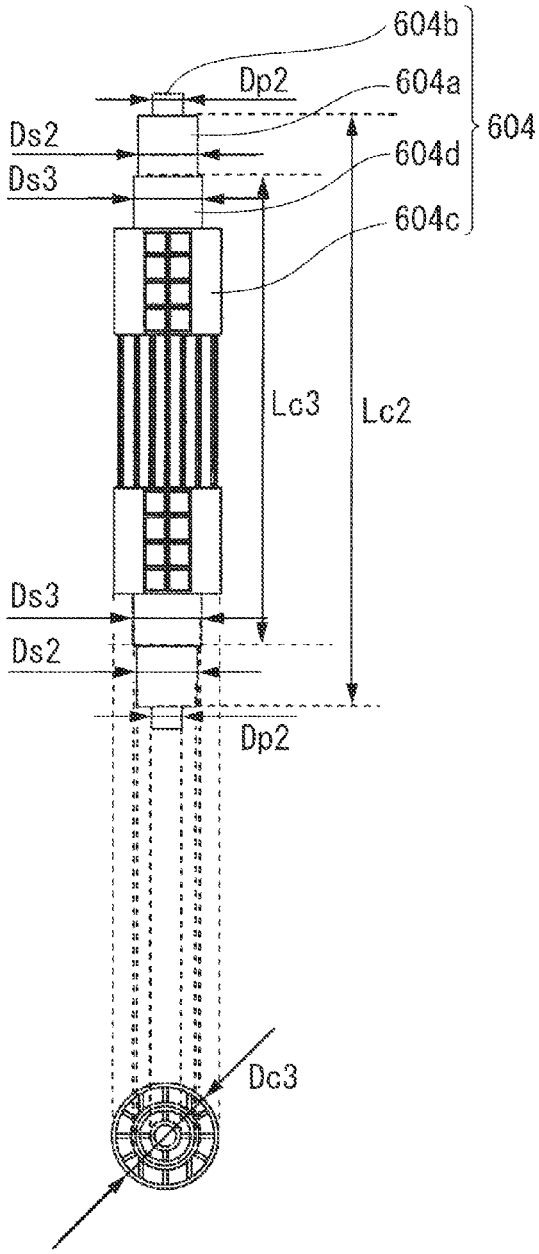

FIGS. 14A and 14B illustrate the card-sized roll paper R3 and the roll paper shaft 604. FIG. 14A illustrates the dimensions of the roll paper R3. FIG. 14B illustrates the dimensions of the roll paper shaft 604.

The width of the roll paper R3 is Lr3 and the inside diameter thereof is Dr3, where, Lr3<Lr2.

The roll paper shaft 604 for the roll paper R3 includes a core portion 604*c*, an end 604*a*, a step 604*d* with a diameter of between the diameters of the core portion 604*c* and the end 604*a*, and a supported portion 604*b* projecting from the end 604*a*.

The core portion 604*c*, the step 604*d*, the end 604*a*, and the supported portion 604*b* increase in diameter in this order.

The length between the steps 604*d* of the roll paper shaft 604 is Lc3. The diameter of the core portion 604*c* of the roll paper shaft 604 is Dc3. The diameter of the step 604*d* of the roll paper shaft 604 is Ds3. The description of the dimensions Ds2, Lc2, and Dp2 (refer to FIG. 8) similar to those in the roll paper shaft 404 for the postcard-sized roll paper R2 is omitted herein.

Since Dr1>Dc1>Dr2>Dc2>Dr3>Dc3, the roll paper shaft 404 for the postcard-sized roll paper R2 and the roll paper shaft 102 for the L-size roll paper R1 cannot be inserted into the card-sized roll paper R3, which prevents the roll paper shaft from being erroneously inserted.

If the integration of the roll paper with the roll paper shaft is used instead of the user inserting the roll paper shaft into the roll paper shaft, the structure for preventing erroneous insertion does not need to be provided on the roll paper shaft to allow realizing a simple configuration.

The configuration in which the card sized roll paper shaft 604 cannot be loaded onto the roll paper storage cassette 1 to which the attachments 601 and 602 are not attached is similar to that in the foregoing exemplary embodiment. In a case where the attachments 601 and 602 are not attached, the regulating lever 110 provided on the lower case 104 is positioned on the concave groove 104*e* to prevent the end 604*a* of the roll paper shaft 604 from being moved.

On the other side of the attachment 601 (the face contacting the end of the roll paper storage cassette 1) is provided with a projection for rotating the regulating lever and a projection for detecting the type of the cassette, as is the case with the attachment 401 for the postcard-sized roll paper R2. For this reason, as is the case with the above-described exemplary embodiment, the attachments 601 and 602 are attached to enable the regulating lever 110 to be retracted from the concave groove 104*e*.

Figure 15:
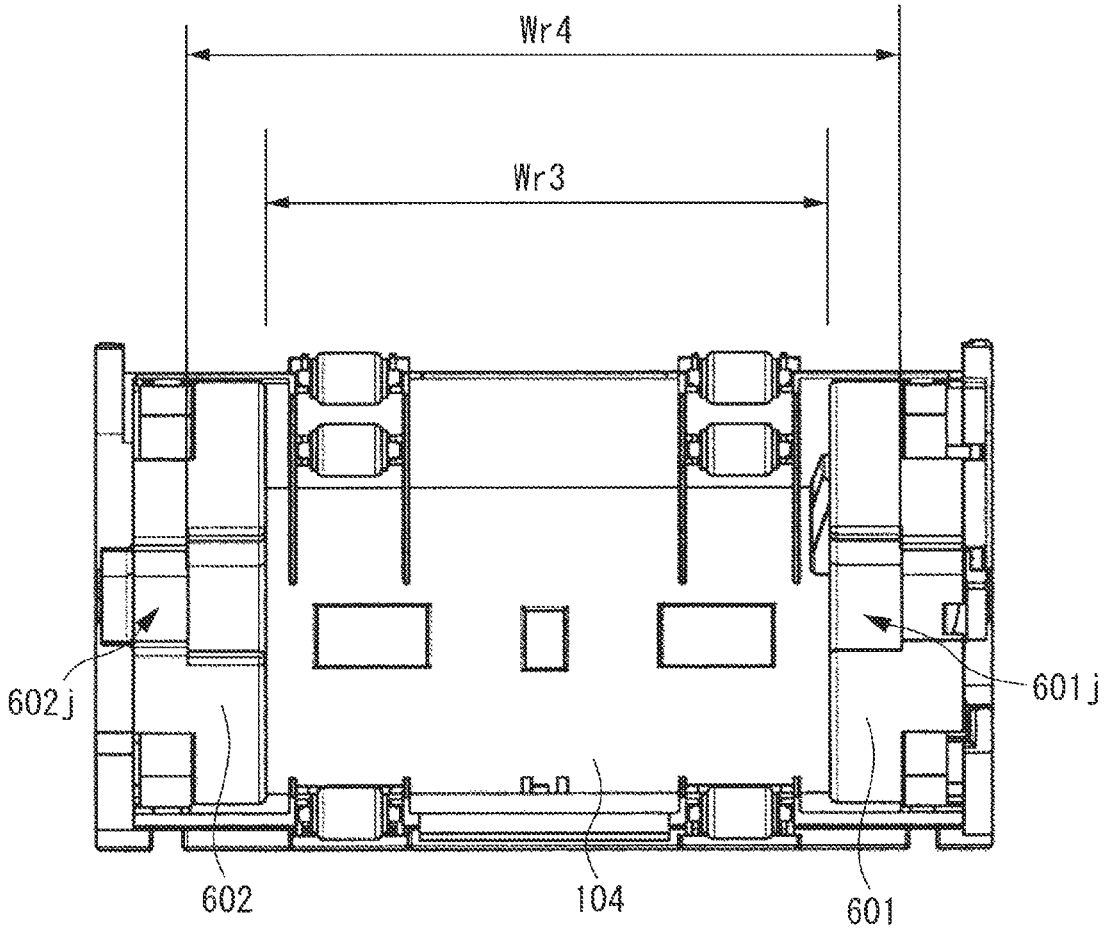
FIG. 15 is a top view of the lower case of the roll paper storage cassette to which the attachments are attached.

FIG. 15 is a top view of the lower case 104 of the roll paper storage cassette 1 to which the attachments 601 and 602 are attached.

A roll paper storage width in a state where the attachments 601 and 602 are attached to the lower case 104 is Wr3. If the length between positions where the diameters of the slots 601*j* and 602*j* of the attachments 601 and 602 are changed respectively is taken as Wr4, Lr3<Wr3<Lc3<Wr4. Since Lr1>Lr2>Wr3>Lr3, the L-size roll paper R1 and the postcard-sized roll paper R2 which are larger in width than the Wr3 are not housed in the lower case 104 to which the attachments 601 and 602 are attached, in other words, only the card-sized roll paper R3 can be housed therein.

Incidentally, the width of thick portion of the slots 601*j* and 602*j* (the side contacting the roll paper R3) is larger than the diameter Ds3 of the step 604*d*. The width of thin portion of the slots 601*j* and 602*j* (the side of end of the lower case 104) is larger than the diameter Ds2 of the end 604*a* and smaller than the diameter Ds3 of the step 604*d*.

Thus, the roll paper shaft 604 inserted into the roll paper R3 can be put into the lower case 104.

Since Lr3<Wr2, the card-sized roll paper R3 can be housed in the lower case 104 to which the attachments 401 and 402 are attached (refer to FIG. 9B). Then, in the roll paper storage cassette according to the present exemplary embodiment, such a relationship that Wr4>Lc3>Wr2>Wr3 is defined and the diameter Ds3 of the step 604*d* is made larger than the width (diameter) of the slot 401*j* of the attachment 401.

Therefore, when the roll paper shaft 604 inserted into the card-sized roll paper R3 is loaded onto the lower case 104 to which the attachments 401 and 402 are attached, the step 604*d* of the roll paper shaft interferes with the slot 401*j* of the attachment 401 not to allow the roll paper shaft to be loaded thereonto.

Thus, even in a case where the L-size, the postcard-sized, and the card-sized roll paper R1, R2, and R3 are used, it can be made easy to agree a combination among the roll paper, the attachment, and the roll paper shaft. Furthermore, the roll paper loaded onto the roll paper storage cassette 1 can be correctly detected, so that the control of conveyance of the roll paper and the setting of a recording size can be correctly performed to enable preventing the occurrence of paper jam, the protrusion of an image, and margin.

The method for loading three types of the roll papers onto the recording apparatus is described above. If four or more types of roll papers are used, only a plurality of steps needs to be provided on the roll paper shaft. Only the shape of the slot of the attachment needs to be changed in accordance with the steps.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-152989 filed Jul. 5, 2010, which is hereby incorporated by reference herein in its entirety.

What is claimed is:

1. A roll paper storage cassette for housing a roll paper wound around a core portion of a roll paper shaft, the roll paper storage cassette comprising:

a pair of openable and closable cases;

an attachment configured to be attached to and/or detached from inside of both ends of the cases according to a size of a roll paper; and a regulation member configured to prevent the roll paper shaft of a specific type from entering and allow the roll paper shaft of another specific type to enter in a state where the attachment is detached, and configured to be moved from a position where the roll paper shaft of the specific type is prevented from entering in a state where the attachment is attached, wherein an end portion of the roll paper shaft projects from the end face of the core portion, and wherein the attachment is provided with a projection, the projection of the attachment moves the regulation member when the attachment is attached, and the moved regulation member does not abut on the end and allow the roll paper shaft of the specific type to enter in housing the roll paper shaft of the specific type into the roll paper storage cassette.

2. The roll paper storage cassette according to claim 1, wherein the roll paper storage cassette is configured to house the roll paper wound around the core portion of the roll paper shaft including the core portion, the end portion is smaller in diameter than the core portion, and a supported portion projecting from the end is smaller in diameter than the end portion, wherein, in a state where the attachment is detached, the regulation member is in a position not to contact, but to oppose the supported portion in housing the roll paper shaft of another specific type into the roll paper storage cassette, and the regulation member is in a position to contact the end portion to prevent the roll paper shaft of the specific type from entering the roll paper storage cassette in housing the roll paper shaft of the specific type into the roll paper storage cassette.

3. The roll paper storage cassette according to claim 2, wherein, when, among the inside diameters of two types of the roll papers different in size, the inside diameter of the larger size roll paper is Dr1, and the inside diameter of the smaller size roll paper is Dr2, the diameter of the core portion of the roll paper shaft for the larger roll paper is Dc1, the diameter of the end portion is Ds1, the diameter of the supported portion is Dp1, the length between the ends is Lc1, the diameter of the core portion of the roll paper shaft for the smaller roll paper is Dc2, the diameter of the end portion is Ds2, the diameter of the supported portion is Dp2, and the length between the ends is Lc2, such a relationship is satisfied that Dr1 is greater than Dc1 is greater than Dr2 is greater than Dc2, Lc2 is greater than Lc1, and Dp1 equals Dp2.

4. The roll paper storage cassette according to claim 3, wherein, when the roll paper storage width of the case is Wr1, the width of the slot for the supported portion of the case is M1, and the width of the concave groove of the case is M2, such a relationship is satisfied that M2 is greater than Ds2, Ds2 equals Ds1, Ds1 is greater than M1, and Lc2 is greater than Wr1 is greater than Lc1.

5. The roll paper storage cassette according to claim 4, wherein the roll paper shaft for a smallest roll paper smaller than the two types of the roll papers includes a step between the core portion and the ends, and the width of slot of the attachment is smaller on the side of the end of the case and larger on the side of the case where the roll paper is housed therein, when the width of the smallest roll paper is Lr3, the inside diameter thereof is Dr3, the length between the steps is Lc3, the diameter of the core portion is Dc3, the diameter of the step is Ds3, the roll paper storage width is Wr3, and the length between positions where the width of the slot of the attachment is changed is Wr4, such a relationship is satisfied that Dc2 is greater than Dr3 is greater than Dc3, and Wr4 is greater than Lc3 is greater than Wr3 is greater than Lr3.

6. The roll paper storage cassette according to claim 1, wherein, on an inner face of the end of the case is provided a concave groove extending from a position on the periphery of an end face of the end through the center of the end, inside the concave groove is provided a slot for a supported portion passing through and along the concave groove, and such a relationship is satisfied that the width of the concave groove is greater than the diameter of the end portion of the roll paper shaft, and is greater than the width of the slot for the supported portion, and is greater than the diameter of the supported portion of the roll paper shaft.

7. A recording apparatus comprising the roll paper storage cassette according to claim 1, an ink ribbon cassette containing an ink ribbon, and a recording apparatus body having a recording unit.

8. The recording apparatus according to claim 7, wherein the recording apparatus body is provided with an attachment identification sensor having a plurality of projections, a detection projection is provided on the one attachment on the end side of the case, and a concave portion and a roll-paper determination portion having a hole passing through the concave portion are provided on the end of the case.

9. A method for preventing roll papers different in size from being erroneously loaded onto the roll paper storage cassette for housing the roll paper wound around the core portion of the roll paper shaft including the core portion, an end projecting from the end face of the core portion and smaller in diameter than the core portion, and a supported portion projecting from the end and smaller in diameter than the end, the roll paper storage cassette, wherein the roll paper storage cassette includes a pair of openable and closable cases, an attachment which can be attached and detached to and from the inside of both ends of the case according to the size of the roll paper and a regulation member, the method comprising:

causing, in a state where the attachment is not attached, the regulation member to abut on the end of the roll paper shaft of a specific type to prevent the roll paper shaft of the specific type from entering the inside of the roll paper storage cassette in housing the roll paper shaft of the specific type into the roll paper storage cassette;

causing the regulation member not to contact, but to oppose the roll paper shaft, allowing the roll paper shaft of another specific type to enter in housing the roll paper shaft of another specific type into the roll paper storage cassette, causing, in a state where the attachment is attached, the regulation member to move to the position where the regulation member does not abut on the end of the roll paper shaft of the specific type to allow the roll paper shaft of the specific type to enter the inside of the roll paper storage cassette, and wherein an attachment provided with a projection is fixed to the inside of both ends of the case according to the size of the roll paper, and the projection moves the regulation member to the position where the regulation member does not abut on the end of the roll paper shaft of the specific type to allow the roll paper shaft of the specific type to enter the inside of the roll paper storage cassette.

10. The method for preventing roll papers from being erroneously loaded according to claim 9, wherein, on the inner face of the end of the case is provided with a concave groove extending from a position on the periphery of an end face of the end through the center of the end, inside the concave groove is provided with a slot for a supported portion passing through along the concave groove, such a relationship is satisfied that the width of the concave groove is greater than the diameter of the end of the roll paper shaft is greater than the width of the slot for the supported portion is greater than the diameter of the supported portion of the roll paper shaft, such a relationship is satisfied that the length between the ends of the roll paper shaft of the specific type is greater than the roll paper storage width of the case is greater than the length between the ends of the roll paper shaft of the other specific type, and in a state where the attachment is detached, only the roll paper shaft of the other specific type is allowed to enter the roll paper storage cassette.

11. The method for preventing roll papers from being erroneously loaded according to claim 9, wherein the roll paper shaft of the specific type is a roll paper shaft for a roll paper larger in size and the roll paper shaft of another specific type is a roll paper shaft for a roll paper smaller in size, and when the inside diameter of the roll paper large in size is Dr1, the inside diameter of the roll paper small in size is Dr2, the diameter of the core portion of the roll paper shaft for the roll paper large in size is Dc1, and the diameter of the core portion of the roll paper shaft for the roll paper small in size is Dc2, such a relationship is established that Dr1 is greater than Dc1 is greater than Dr2 is greater than Dc2 to prevent the roll paper shaft for the roll paper large in size from entering the roll paper small in size.

* * * * *